US009844125B2

(12) United States Patent
Jhon et al.

(10) Patent No.: US 9,844,125 B2
(45) Date of Patent: Dec. 12, 2017

(54) APPARATUS FOR GENERATING EXTREME ULTRA-VIOLET BEAM USING MULTI-GAS CELL MODULES

(71) Applicant: KOREA INSTITUTE OF SCIENCE AND TECHNOLOGY, Seoul (KR)

(72) Inventors: Young Min Jhon, Seoul (KR); Yong Soo Kim, Seoul (KR); Joon Mo Ahn, Seoul (KR); Min Ah Seo, Seoul (KR); Jae Hun Kim, Seoul (KR); Min Chul Park, Seoul (KR); Young Tae Byun, Seoul (KR); Chul Ki Kim, Seoul (KR); Seok Lee, Seoul (KR); Deok Ha Woo, Seoul (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 0 days.

(21) Appl. No.: 14/979,729

(22) Filed: Dec. 28, 2015

(65) Prior Publication Data

US 2016/0192467 A1 Jun. 30, 2016

(30) Foreign Application Priority Data

Dec. 26, 2014 (KR) ..... 10-2014-0191162

(51) Int. Cl.
*H05G 2/00* (2006.01)

(52) U.S. Cl.
CPC ..... *H05G 2/003* (2013.01); *H05G 2/008* (2013.01)

(58) Field of Classification Search
None
See application file for complete search history.

(56) References Cited

U.S. PATENT DOCUMENTS

2004/0183037 A1* 9/2004 Klein ..... H05G 2/003 250/504 R
2008/0069171 A1* 3/2008 Rocca ..... G02F 1/3501 372/61
2010/0078580 A1* 4/2010 Endo ..... H05G 2/003 250/504 R
2010/0098118 A1* 4/2010 Kim ..... G02F 1/353 372/22
2011/0013653 A1* 1/2011 Krausz ..... G02F 1/3501 372/22
2015/0086148 A1* 3/2015 Liu ..... G02F 1/3544 385/1
2015/0097107 A1* 4/2015 Lim ..... H05G 2/003 250/208.1

FOREIGN PATENT DOCUMENTS

KR 101349898 B1 1/2014

* cited by examiner

*Primary Examiner* — Michael Logie
(74) *Attorney, Agent, or Firm* — Ladas & Parry LLP

(57) ABSTRACT

Provided is an extreme ultra-violet (EUV) beam generation apparatus using multi-gas cell modules in which a gas is prevented from directly flowing into a vacuum chamber by adding an auxiliary gas cell serving as a buffer chamber to a main gas cell, a diffusion rate of the gas is decreased, a high vacuum state is maintained, and a higher power EUV beam is continuously generated.

7 Claims, 5 Drawing Sheets

APPARATUS FOR GENERATING EXTREME ULTRA-VIOLET BEAM USING MULTI-GAS CELL MODULES

CROSS-REFERENCE TO RELATED APPLICATION

This application claims priority to and the benefit of Korean Patent Application No. 2014-0191162, filed on Dec. 26, 2014, the disclosure of which is incorporated herein by reference in its entirety.

BACKGROUND

1. Field of the Invention

The present invention relates to an extreme ultra-violet (EUV) beam generation apparatus using multi-gas cell modules, and more particularly, to an EUV beam generation apparatus using multi-gas cell modules in which a gas is prevented from directly flowing into a vacuum chamber by adding an auxiliary gas cell serving as a buffer chamber to a main gas cell, a diffusion rate of the gas is decreased, a high vacuum state is maintained, and a higher power EUV beam is continuously generated.

2. Discussion of Related Art

Generally, an extreme ultra-violet (EUV) beam, for example, electromagnetic radiation (also known as soft X-rays) having a wavelength of about 50 nm or less, which includes light having a wavelength of 13.5 nm, can be used in a photolithography process to form a very small pitch on a substrate, for example, a silicon wafer.

That is, EUV light and X-rays are located in a shorter wavelength region than visible light, and thus can improve measurement resolution according to a diffraction limit which limits sizes of wavelengths in precision measurement using light, and can be used for fine measurement or nondestructive testing involved in biotechnology using a good transmission characteristic by extending to the X-ray region.

Specifically, when a good coherent light source can be generated at the same time, various applications using interference and diffraction phenomena of light are possible. Since a repetition rate of an incident femtosecond laser can be maintained, it can be used for precision spectroscopy, frequency standard measurement, or the like in EUV and X-ray regions.

One of the various methods of generating EUV light and X-rays is a method using a synchrotron. When EUV light and X-rays are generated using the synchrotron, there are advantages in that a large amount of light of good quality can be obtained and various wavelength bands can be obtained at the same time, however, since a facility itself is very enormous and expensive, there is a problem in that it cannot be simply configured in a laboratory stage.

Recently, as a method of overcoming this problem, a high-order harmonic generation (HHG) method using a femtosecond laser has been proposed, and thus coherent EUV light and soft X-rays can be generated with a relatively small experimental device.

In the HHG method, electrons are ionized, move along a track and are recombined by applying a high time-varying electric field to an inert gas such as, for example, argon (Ar), neon (Ne), xenon (Xe), and the like, and the energy corresponding to the sum of the ionization energy and kinetic energy of the electrons generates light of the EUV and X-ray band.

HHG has typically been designed or made so that an inert gas is injected into a gas cell and the used inert gas naturally leaves the gas cell.

However, in the conventional technique, the inert gas leaving the gas cell is immediately discharged into the vacuum chamber, and thus it is disadvantageous in that an environment in the vacuum chamber is contaminated or a degree of vacuum inside the vacuum chamber is decreased. Specifically, the generated EUV beam is absorbed by the inert gas exposed inside the vacuum chamber, and thus there is a serious problem in that the output of the EUV beam is reduced.

In order to address the above problem, in Korea Patent No. 10-1349898 (module for extreme ultra-violate beam generation) filed and registered by the same applicant, a module for generating a EUV beam which is a high-order harmonic by interacting a laser beam with an inert gas in a vacuum chamber is disclosed.

However, in the above related art, which is related to a single gas cell module, gas is injected in a vacuum state and a laser passes therethrough, and an EUV beam generated at this time should be measured. It is difficult to control an amount of the gas for maintaining a degree of vacuum due to the instantaneous diffusion of the gas injected inside the vacuum chamber as well as difficult to maintain a vacuum state due to the injected gas, and it is difficult to maintain the degree of vacuum. Thus, there is a problem in that the EUV beam cannot be continuously generated for a long time.

SUMMARY OF THE INVENTION

The present invention is directed to an extreme ultra-violet (EUV) beam generation apparatus using multi-gas cell modules in which a gas is prevented from directly flowing into a vacuum chamber by adding an auxiliary gas cell serving as a buffer chamber to a main gas cell, a diffusion rate of the gas is decreased, a high vacuum state is maintained, and a higher power EUV beam is continuously generated.

According to an aspect of the present invention, there is provided an EUV beam generation apparatus using multi-gas cell modules, including: a main gas cell module disposed in a vacuum chamber for generating an EUV beam and including a main housing which forms the entirety of a body thereof, a laser incident path formed on a first side surface of the main housing to pass a laser beam which is transmitted through a plurality of optical members included in the vacuum chamber to be incident, an EUV emission path formed on a second side surface of the main housing to communicate with the laser incident path on a coaxial line so as to emit an EUV beam, which is generated by interacting the laser beam incident through the laser incident path with an external inert gas, to the second side surface of the main housing, and a gas supply flow path formed on a third side surface of the main housing to communicate with the laser incident path or the EUV emission path so as to supply the external inert gas to the laser incident path or the EUV emission path; a first auxiliary gas cell module coupled to a first side surface of the main gas cell module and including a first auxiliary housing which forms the entirety of a body thereof, a laser incident extending path formed on a first side surface of the first auxiliary housing to communicate with the laser incident path on a coaxial line so as to transmit the laser beam, which is incident to the laser incident path, to the laser incident path, and a first gas discharge flow path formed on a second side surface of the first auxiliary housing to communicate with the laser incident extending path so as to discharge the inert gas supplied to the laser incident path to an outside of the vacuum chamber through the laser incident extending path; and a second auxiliary gas cell module including a second auxiliary housing which is coupled to a second side surface of the main gas cell module and forms the entirety of a body thereof, an EUV emission extending path formed on a first side surface of the second auxiliary housing to communication with the EUV emission path on a coaxial line so as to emit the EUV beam received from the EUV emission path into the vacuum chamber, and a second gas discharge flow path formed on a second side surface of the second auxiliary housing to communicate with the EUV emission extending path so as to discharge the inert gas supplied to the EUV emission path to the outside of the vacuum chamber through the EUV emission extending path, and the inert gas is supplied from the outside of the vacuum chamber to the gas supply flow path through a gas supply port and a gas supply pipe which are connected to an end of the gas supply flow path, and the inert gas is discharged to the outside of the vacuum chamber through first and second gas discharge ports and first and second gas discharge pipes which are respectively connected to ends of the first and second gas discharge flow paths.

Here, at least two of the first and second auxiliary gas cell modules may extend and may be respectively coupled to the first and second side surfaces of the main gas cell module.

Preferably, the apparatus may further include a pressure controller which is provided at any one portion of the gas supply port, the gas supply pipe, and a portion therebetween and controls a pressure and a flow rate of the inert gas according to an intensity of the laser beam.

Preferably, the apparatus may further include a pressure adjusting valve which is provided at any one portion of the first and second gas discharge ports, the first and second gas discharge pipes, a portion between the first and second gas discharge ports, and a portion between the first and second gas discharge pipes and adjusts a pressure of the inert gas using an aperture principle.

Preferably, diameters of the laser incident path and the EUV emission path of the main gas cell module, and diameters of the laser incident extending path and the EUV emission extending path of the first and second auxiliary gas cell modules may be formed to be smaller than a diameter of the gas supply flow path of the main gas cell module and diameters of the first and second gas discharge flow paths of the first and second auxiliary gas cell modules.

Preferably, the inert gas may include at least any one of helium (He), neon (Ne), and argon (Ar).

Preferably, the apparatus may further include an auxiliary housing which is insertable and attachable between at least two of the first and second auxiliary gas cell modules and to one of outer surfaces thereof and having a diameter of a hole smaller than or equal to diameters of the laser incident path, the laser incident extending path, and the EUV emission extending path as required.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, various embodiments will now be described more fully with reference to the accompanying drawings in which some embodiments are shown. However, since the invention is not limited to the embodiments disclosed hereinafter, the embodiments of the invention should be implemented in various forms. The embodiments of the invention are only provided for complete disclosure of the invention and to fully show the scope of the invention to those skilled in the art, and only defined by the scope of the appended claims. The same reference numbers will be used throughout this specification to refer to the same or like components. As used herein, the term "and/or" includes each and all combinations of at least one of the referred items.

It will be understood that, although the terms first, second, etc. may be used herein to describe various elements, components and/or sections, these elements, components, and/or sections should not be limited by these terms. These terms are only used to distinguish one element, component, or section from another. Therefore, a first element, a first component, or a first section could be termed a second element, a second component, or a second section within the scope of the invention.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In descriptions of the invention, when it is determined that detailed explanations of related well-known functions or configurations unnecessarily obscure the gist of the invention, the detailed description thereof will not be repeated. Some terms described below are defined in consideration of functions in the invention, and meanings may vary depending on, for example, a user or operator's intentions or customs. Therefore, the meanings of terms should be interpreted based on the scope throughout this specification.

Figure 1:
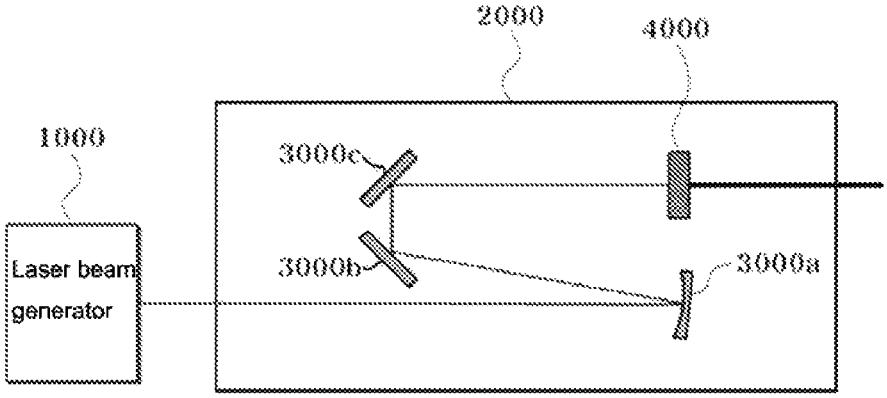
FIG. 1 is a schematic diagram illustrating an overall configuration of a system including an extreme ultra-violet (EUV) beam generation apparatus using multi-gas cell modules according to an embodiment of the present invention.
Figure 2:
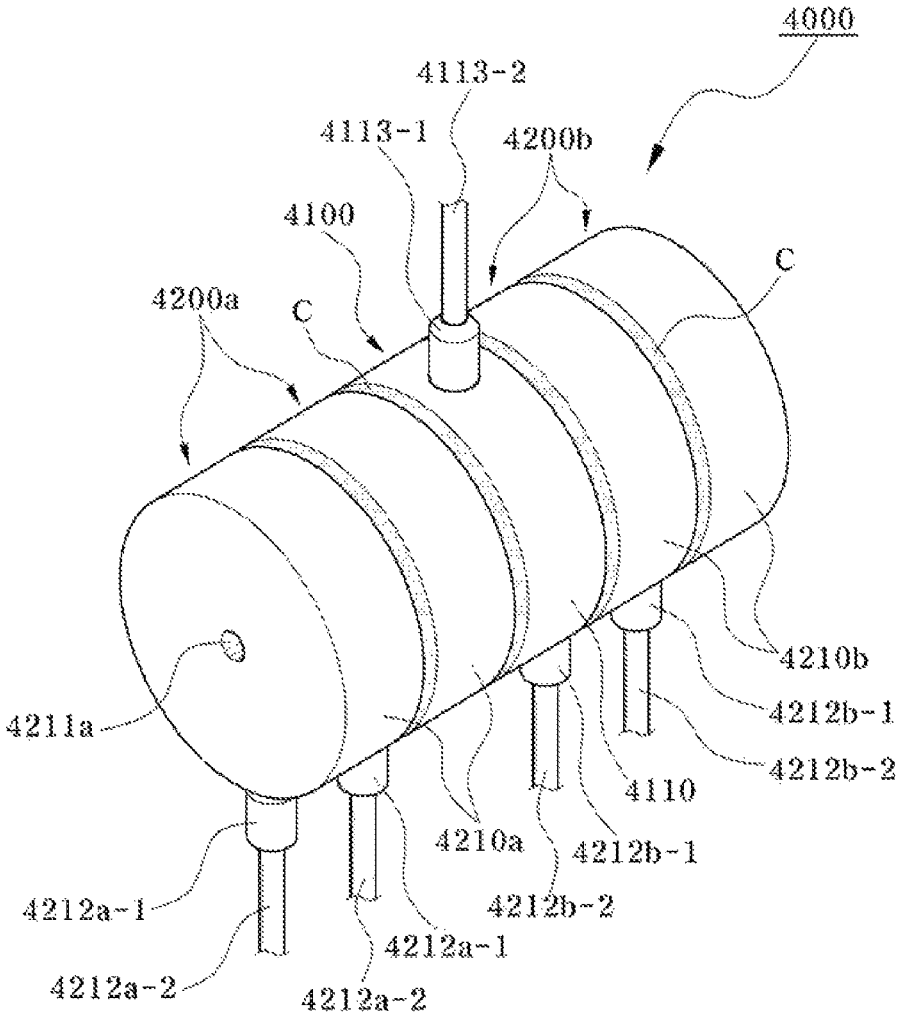
FIG. 2 is a perspective view for describing an EUV beam generation apparatus using multi-gas cell modules according to an embodiment of the present invention.
Figure 3:
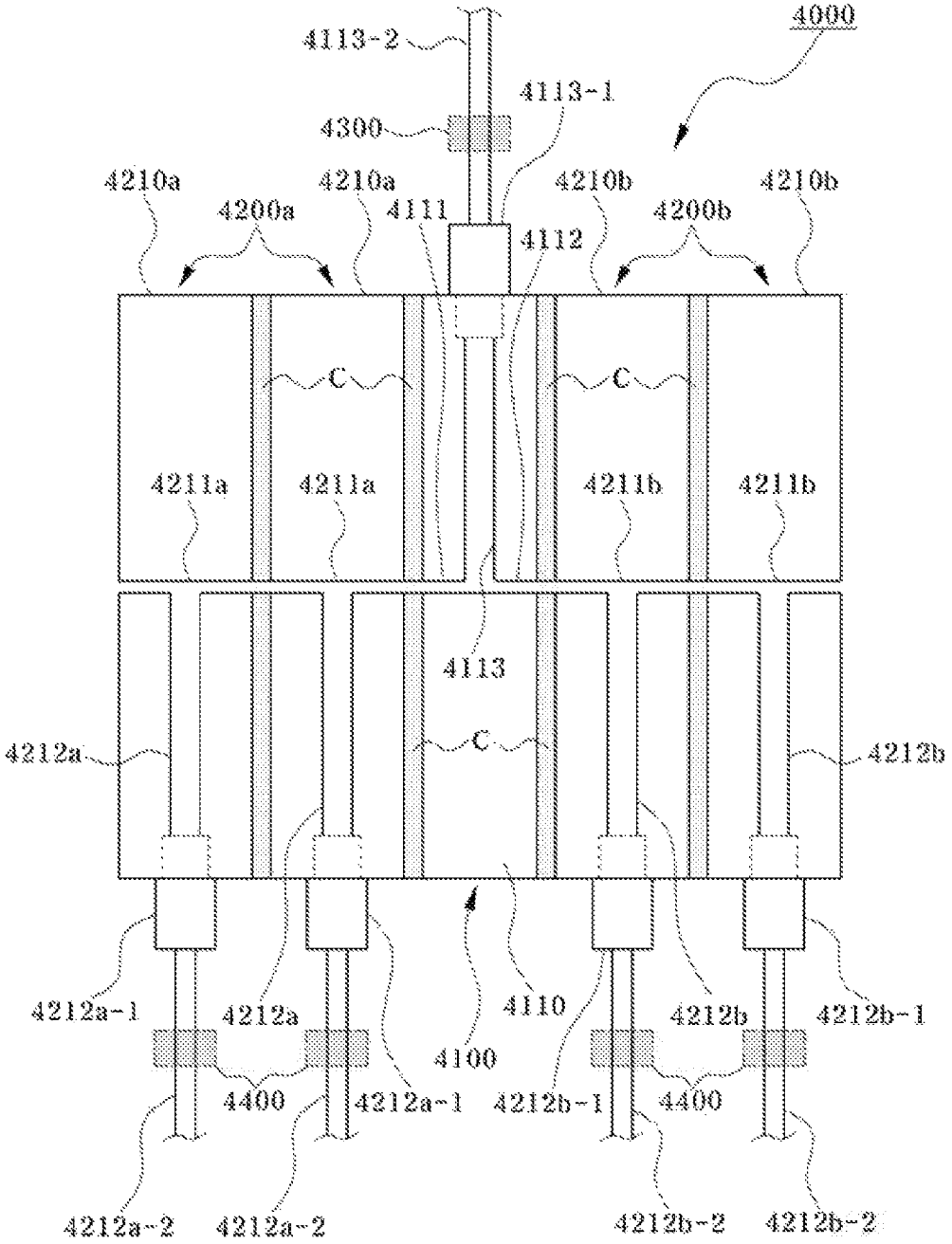
FIG. 3 is a side sectional view illustrating an EUV beam generation apparatus using multi-gas cell modules according to an embodiment of the present invention.
Figure 4:
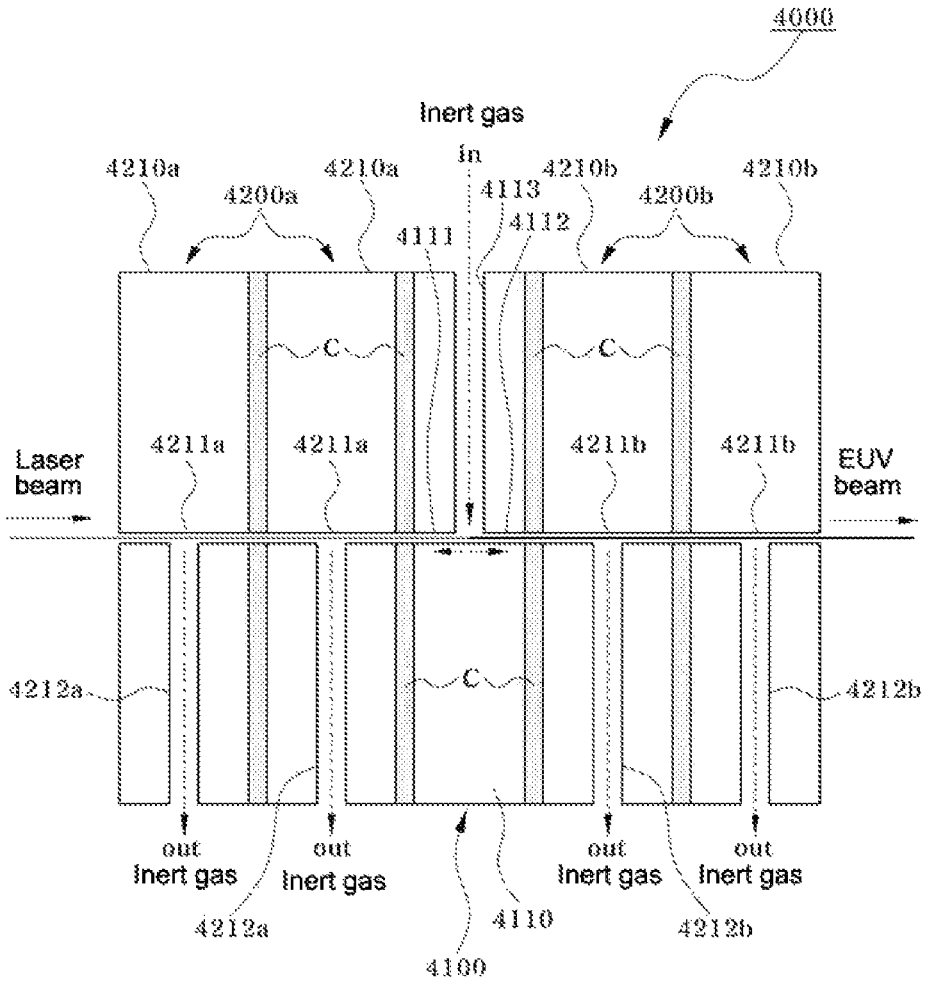
FIG. 4 is a conceptual view schematically illustrating operations of an EUV beam generation apparatus using multi-gas cell modules according to an embodiment of the present invention.

FIG. 1 is a schematic diagram illustrating an overall configuration of a system including an extreme ultra-violet (EUV) beam generation apparatus using multi-gas cell modules according to an embodiment of the present invention. FIG. 2 is a perspective view for describing the EUV beam generation apparatus using multi-gas cell modules according to the embodiment of the present invention. FIG. 3 is a side sectional view illustrating the EUV beam generation apparatus using multi-gas cell modules according to the embodiment of the present invention. FIG. 4 is a conceptual view schematically illustrating operations of the EUV beam generation apparatus using multi-gas cell modules according to the embodiment of the present invention.

Referring to FIGS. 1 to 4, an EUV generation system including an EUV beam generation apparatus using multi-gas cell modules according to the embodiment of the present invention mainly includes a laser beam generator 1000, a vacuum chamber 2000, a plurality of optical members 3000*a* to 3000*c*, and an EUV beam generation apparatus 4000.

Here, the laser beam generator 1000, which is a laser oscillator for outputting light with an intensity of about $10^{11}$ W/cm$^2$, outputs a femtosecond laser as a light source for high-order harmonic generation (HHG) according to the embodiment of the present invention.

As an exemplary embodiment according to the present invention, the laser beam generator 1000 has a 35 femtosecond pulse width and outputs a femtosecond laser through a laser oscillator of which titanium sapphire (Ti:s) is used as a laser gain medium. The conditions of the femtosecond laser such as a pulse width, a wavelength, and the like may be changed in various embodiments such as a fiber-based femtosecond laser and the like according to usage or an environment.

Further, the femtosecond laser generated in the laser beam generator 1000 has a laser repetition rate of 1 kHz or more and a maximum energy per pulse of several mJ.

Since the vacuum chamber 2000 is a chamber that maintains its internal environment in a vacuum state, pressure in the chamber through which the EUV beam passes is preferably about $10^{-5}$ Torr or less, and partial pressures of oxygen and water are preferably as low as possible.

Meanwhile, almost any environment other than that of the laser beam generator 1000 is preferably disposed within the vacuum chamber 2000. That is, since all of the EUV light source is absorbed in the air, it should be made in the vacuum chamber 2000, and analysis of characteristics of a generated EUV light source should also be performed in the vacuum chamber 2000 when the EUV light source is generated.

The plurality of optical members 3000*a* to 3000*c* are disposed inside the vacuum chamber 2000 to properly transmit a high-power laser beam generated from the laser beam generator 1000. For example, the laser beam generated from the laser beam generator 1000 moves toward a first optical member 3000*a* constituted of, for example, a concave mirror, and the beam focused through the first optical member 3000*a* is reflected to the second and third optical members 3000*b* and 3000*c* and transmitted to the EUV beam generation apparatus 4000. The number and placement of the plurality of optical members 3000*a* to 3000*c* are variable by those skilled in the art according to the design.

Specifically, the EUV beam generation apparatus 4000 according to an embodiment of the present invention performs a function of injecting an inert gas to create the EUV light source with a wavelength band in the range of about 6.75 nm to 13.65 nm and maintaining constant pressure by collecting the inert gas.

The EUV beam generation apparatus 4000 is disposed in the vacuum chamber 2000 for generating an EUV beam, and mainly includes a main gas cell module 4100 and at least one of first and second auxiliary gas cell modules 4200*a* and 4200*b*.

Here, the main gas cell module 4100 includes, for example, a main housing 4110 having a disc shape, which forms the entirety of a body thereof.

A laser incident path 4111 is formed on a first side surface of the main housing 4110 so that a laser beam transmitted through the plurality of optical members 3000*a* to 3000*c* included in the vacuum chamber 2000 is incident and passes therethrough.

Further, an EUV emission path 4112 in communication with the laser incident path 4111 on a coaxial line is formed on a second side surface of the main housing 4110 so that an EUV beam generated by interacting the laser beam incident through the laser incident path 4111 with an external inert gas (e.g., He, Ne, Ar, or the like) is emitted to the second side surface of the main housing 4110.

Further, a gas supply flow path 4113 in communication with the laser incident path 4111 and/or the EUV emission path 4112 (preferably, a connection portion of the laser incident path and the EUV emission path) is formed on a third side surface of the main housing 4110 so that the external inert gas is supplied to the laser incident path 4111 and/or the EUV emission path 4112.

Meanwhile, when the main housing 4110 applied to the embodiment of the present invention is formed, for example, to have a disc shape, the first and second side surfaces of the main housing 4110 may correspond to a front surface and a rear surface, respectively, and the third side surface of the main housing 4110 may correspond to an outer peripheral side surface as illustrated in FIG. 2. Further, the main housing 4110 applied to the embodiment of the present invention is formed to have the disc shape, but is not limited thereto. Any form is possible as long as the form has a plurality of surfaces.

Also, a first auxiliary gas cell module 4200*a*, which is a module that serves as a buffer cell, is coupled to the first side surface of the main housing 4110 included in the main gas cell module 4100, and includes a first auxiliary housing 4210*a*, for example, having a disc shape forming the entirety of a body thereof.

A laser incident extending path 4211*a* in communication with the laser incident path 4111 on a coaxial line is formed on a first side surface of the first auxiliary housing 4210*a* so that the laser beam transmitted through the plurality of optical members 3000*a* to 3000*c* included in the vacuum chamber 2000 is incident and transmitted to the laser incident path 4111 of the main housing 4110.

Further, a first gas discharge flow path 4212*a* in communication with the laser incident extending path 4211*a* is formed on a second side surface of the first auxiliary housing 4210*a* so that the inert gas supplied to the laser incident path 4111 is discharged to the outside of the vacuum chamber 2000 through the laser incident extending path 4211*a*.

Also, a second auxiliary gas cell module 4200*b*, which is a module that serves as a buffer cell, is coupled to the second side surface of the main housing 4110 included in the main gas cell module 4100, and includes a second auxiliary housing 4210*b*, for example, having a disc shape forming the entirety of a body thereof.

An EUV emission extending path 4211*b* in communication with the EUV emission path 4112 of the main housing 4110 on a coaxial line is formed on a first side surface of the second auxiliary housing 4210*b* so that the EUV beam received from the EUV emission path 4112 of the main housing 4110 is emitted into the vacuum chamber 2000.

Further, a second gas discharge flow path 4212*b* in communication with the EUV emission extending path 4211*b* is formed on a second side surface of the second auxiliary housing 4210*b* so that the inert gas supplied to the EUV emission path 4112 is discharged to the outside of the vacuum chamber 2000 through the EUV emission extending path 4211*b*.

At least two of the first and second auxiliary gas cell modules 4200*a* and 4200*b* configured as above extend and are preferably respectively coupled to the first and second side surfaces of the main gas cell module 4100.

Meanwhile, when the first and second auxiliary housings 4210*a* and 4210*b* applied to the embodiment of the present invention are formed, for example, to have a disc shape, the first side surfaces of the first and second auxiliary housings 4210*a* and 4210*b* may correspond to a front surface and a rear surface, respectively, and the second side surfaces of the first and second auxiliary housings 4210*a* and 4210*b* may correspond to outer peripheral side surfaces as illustrated in FIG. 2. Further, the first and second auxiliary housings 4210*a* and 4210*b* applied to the embodiment of the present invention are formed to have the disc shape, but are not limited thereto. Any form is possible as long as the form has a plurality of surfaces.

On the other hand, the main housing 4110 and the first and second auxiliary housings 4210*a* and 4210*b* applied to the embodiment of the present invention are preferably coupled and fixed through a conventional fixing means (e.g., an adhesive, an adhesive tape, screws, and the like) C, but are not limited thereto. The main housing 4110 and the first and second auxiliary housings 4210*a* and 4210*b* may be coupled and fixed using a connecting plate and the like of a conventional metal or plastic material. Further, diameters of holes in the first and second auxiliary housings 4210*a* and 4210*b* may be smaller than or equal to those of the laser incident path 4111, the laser incident extending path 4211*a*, and the EUV emission extending path 4211*b*.

Also, the inert gas is preferably configured to be supplied to the gas supply flow path 4113 from the outside of the vacuum chamber 2000 through a gas supply port 4113-1 and a gas supply pipe 4113-2 which are connected to an end of the gas supply flow path 4113.

Further, the inert gas is preferably configured to be supplied to the outside of the vacuum chamber 2000 through first and second gas discharge ports 4212*a*-1 and 4212*b*-1 and first and second gas discharge pipes 4212*a*-2 and 4212*b*-2 which are respectively connected to ends of the first and second gas discharge flow paths 4212*a* and 4212*b*.

Meanwhile, the gas supply port 4113-1 and the first and second gas discharge ports 4212*a*-1 and 4212*b*-1 are preferably implemented by a conventional standardized ⅛" tab, that can be respectively connected to the gas supply pipe 4113-2 and the first and second gas discharge pipes 4212*a*-2 and 4212*b*-2, and the gas supply pipe 4113-2 and the first and second gas discharge pipes 4212*a*-2 and 4212*b*-2 are preferably implemented by a conventional metal pipe or tube.

Additionally, a pressure controller 4300 which controls a pressure and a flow rate of the inert gas according to the intensity of the laser beam generated from the laser beam generator 1000 may be further provided at a portion in which the inert gas enters the EUV beam generation apparatus 4000, for example, any one portion of the gas supply port 4113-1, the gas supply pipe 4113-2, and a portion therebetween which are connected to the gas supply flow path 4113.

The pressure controller 4300, which is a device which adjusts a pressure of a gas inside the EUV beam generation apparatus 4000, serves to numerically control an amount of the inert gas injected into the EUV beam generation apparatus 4000.

Further, a pressure adjusting valve 4400 which adjusts the pressure of the inert gas using an aperture principle may be further provided at a portion in which the inert gas is output to the EUV beam generation apparatus 4000, for example, any one portion of the first and second gas discharge ports 4212*a*-1 and 4212*b*-1, the first and second gas discharge pipes 4212*a*-2 and 4212*b*-2, a portion between the first and second gas discharge ports 4212*a*-1 and 4212*b*-1, and a portion between the first and second gas discharge pipes 4212*a*-2 and 4212*b*-2.

The pressure adjusting valve 4400, which is a valve that is attached to the inside of a tube or an end of the tube and can variably adjust a flow rate or fluid pressure of a gas flowing along the tube, may be implemented so that aperture plates which have been opened to a predetermined size by the elastic force of a spring are contracted or relaxed in the beginning and a cross sectional area of the flow path is adjusted. Thus, the pressure adjusting valve 4400 may be implemented as, for example, an active controlled aperture type variable valve which adjusts the opening area of the valve and actively controls the flow rate and fluid pressure of the gas flowing along the tube, or a semi-active controlled aperture type variable valve of which the opening area is passively changed according to the magnitude of the pressure on a surface of the aperture by the gas flowing along the tube.

Meanwhile, diameters of the laser incident path 4111 and the EUV emission path 4112 of the main gas cell module 4100, and diameters of the laser incident extending path 4211*a* and the EUV emission extending path 4211*b* of the first and second auxiliary gas cell modules 4200*a* and 4200*b* are formed to be smaller than diameters (preferably, of about 2 mm) of the gas supply flow path 4113 of the main gas cell module 4100 and the first and second gas discharge flow paths 4212*a* and 4212*b* of the first and second auxiliary gas cell modules 4200*a* and 4200*b*, and thus the discharge of the inert gas inside the EUV beam generation apparatus 4000 to the laser incident path 4111, the laser incident extending path 4211*a*, the EUV emission path 4112, and the EUV emission extending path 4211*b* is minimized, and thus it is possible to effectively prevent the inside of the vacuum chamber 2000 from being contaminated.

Alternatively, as the inert gas applied to the embodiment of the present invention, for example, at least any one of helium (He), neon (Ne), and argon (Ar) is preferably used, but is not limited thereto. Various inert gases in addition to helium (He), neon (Ne), or argon (Ar) may be used.

In the HHG method through the EUV beam generation apparatus 4000 according to the embodiment of the present invention as configured above, for example, electrons are ionized, move along a track and are recombined due to a high time-varying electric field applied to an inert gas such as helium (He), neon (Ne), or argon (Ar) or a mixed gas thereof, and energy corresponding to the sum of the ionization energy and kinetic energy of the electrons generates an EUV beam.

That is, as illustrated in FIG. 4, a light source for generating an EUV beam which is a high-order harmonic is obtained using the EUV beam generation apparatus 4000. The laser beam is emitted from the laser beam generator 1000, and is focused in the laser incident path 4111 of the main housing 4110 of the EUV beam generation apparatus 4000 filled with the inert gas and the laser incident extending path 4211*a* of the first auxiliary housing 4210*a* by adjusting the energy of the laser beam and the size and chirp of the beam through the plurality of optical members 3000*a* to 3000*c* included in the vacuum chamber 2000.

When the femtosecond laser beam is incident on atoms of the inert gas concentrated in the main housing 4110 and the first auxiliary housing 4210*a* of the EUV beam generation apparatus 4000, electrons break free from the atoms of the inert gas contained in the main housing 4110 and the first auxiliary housing 4210*a* by a strong electric field of the laser and are ionized by a tunneling effect.

The ionized electrons are no longer affected by the atoms, are accelerated by the strong electric field exerted by the laser, and gain kinetic energy while being accelerated. Then, the electric field of the laser is changed, and the electrons are recombined with the atoms.

In this case, the energy corresponding to the sum of the kinetic energy obtained by the laser and the ionization energy generated by recombining the atoms and the electrons is emitted as light, and becomes an EUV light source. Further, since the generated EUV beam is absorbed by impurities in the air and disappears, it should be made in a vacuum environment, that is, in the vacuum chamber 2000.

That is, since the whole processes should be performed in a state in which the degree of vacuum is maintained in the vacuum chamber 2000 and the absorption of the EUV beam does not occur, the maintenance of the degree of vacuum is most important. To this end, the first and second auxiliary gas cell modules 4200*a* and 4200*b*, which are buffer cells that mitigate a rapid diffusion of the gas into the vacuum chamber 2000, are provided.

Meanwhile, although it is impossible to maintain the degree of vacuum (e.g., $10^{-4}$ Torr to $10^{-5}$ Torr) in the conventional single gas cell module, it is possible to maintain the degree of vacuum in the EUV beam generation apparatus using the multi-gas cell modules according to the embodiment of the present invention.

Also, although a maintenance time of the degree of vacuum is about 0.5 seconds or less in the conventional single gas cell module, it is permanent in the EUV beam generation apparatus using the multi-gas cell modules according to the embodiment of the present invention when a pump operates.

Further, although it is impossible to apply gas pressure (flow rate) adjustment in the conventional single gas cell module, it is possible in the EUV beam generation apparatus using the multi-gas cell modules according to the embodiment of the present invention.

Figure 5:
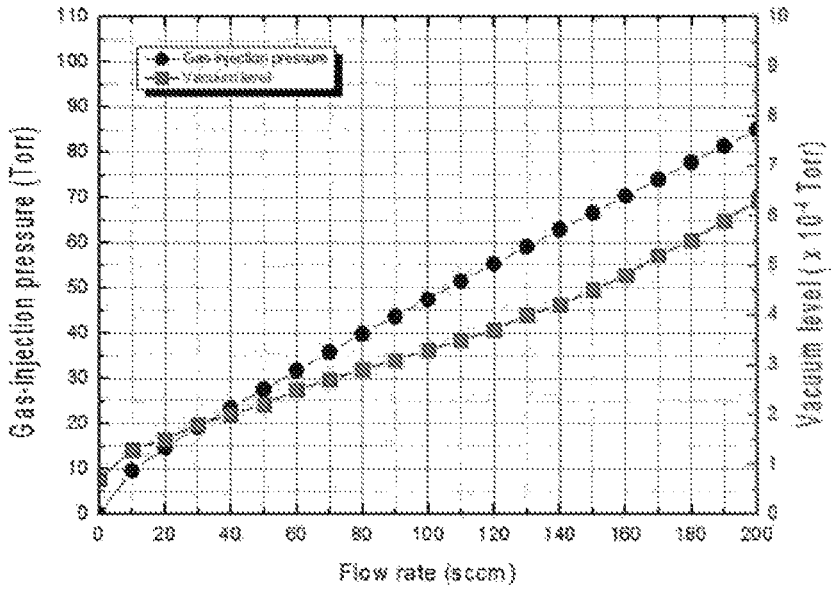
FIG. 5 is a graph illustrating a degree of vacuum and gas injection pressure actually measured according to a gas flow rate in a system including an EUV beam generation apparatus using multi-gas cell modules according to an embodiment of the present invention.

That is, as illustrated in FIG. 5, when the multi-gas cell modules are used, the gas is injectable by adjusting the gas flow rate, the degree of vacuum is well maintained (several $10^{-4}$ Torrs or less) even in the high gas flow rate and gas injection pressure, and the EUV beam may be continuously generated. In this case, the diameters of the main gas cell module 4100 and the laser incident extending path 4211*a* of the first and second auxiliary gas cell modules 4200*a* and 4200*b* are 2 mm, the length of the main gas cell module 4100 is 10 mm, and the lengths of the first and second auxiliary gas cell modules 4200*a* and 4200*b* are 12 mm.

Further, in order to continuously generate the EUV beam, continuous gas injection and maintenance of the degree of vacuum (several $10^{-4}$ Torr or less) are required. Since it is impossible to continuously generate the EUV beam when the conventional single gas cell module is applied, the EUV beam generation apparatus using the multi-gas cell modules according to the embodiment of the present invention is applicable to the EUV laser source.

According to the above-described EUV beam generation apparatus using multi-gas cell modules, a gas is prevented from directly flowing into a vacuum chamber by adding an auxiliary gas cell serving as a buffer chamber to a main gas cell, a diffusion rate of the gas is decreased, a high vacuum state is maintained, and thus a higher power EUV beam can be continuously generated. Also, it is possible to easily control an amount of the gas for maintaining a degree of vacuum.

While exemplary embodiments with respect to an EUV beam generation apparatus using multi-gas cell modules according to the present invention have been described, the invention is not limited thereto and may be embodied with various modifications within the scope of the appended claims detailed description and the accompanying drawings, and such embodiments are also within the scope of the invention.

What is claimed is:

1. An extreme ultra-violet (EUV) beam generation apparatus using multi-gas cell modules, the apparatus comprising:

a main gas cell module disposed in a vacuum chamber for generating an EUV beam and including a main housing configured to form the entirety of a body thereof, a laser incident path formed on a first side surface of the main housing to pass a laser beam which is transmitted through a plurality of optical members included in the vacuum chamber to be incident, an EUV emission path formed on a second side surface of the main housing to communicate with the laser incident path on a coaxial line so as to emit an EUV beam, which is generated by interacting the laser beam incident through the laser incident path with an external inert gas, to the second side surface of the main housing, and a gas supply flow path formed on a third side surface of the main housing to communicate with the laser incident path or the EUV emission path so as to supply the external inert gas to the laser incident path or the EUV emission path;

a plurality of first auxiliary gas cell modules coupled to a first side surface of the main gas cell module, each individual first auxiliary gas cell module comprising:

a first auxiliary housing configured to form the entirety of a body of the first auxiliary gas cell module thereof that is coupled to the first side surface of the main gas cell module by a fixative, a laser incident extending path formed on a first side surface of the first auxiliary housing to communicate with the laser incident path on a coaxial line so as to transmit the incident laser beam to the laser incident path, to the laser incident path, and a first gas discharge flow path formed on a second side surface of the first auxiliary housing to communicate with the laser incident extending path so as to discharge the inert gas supplied to the laser incident path to an outside of the vacuum chamber through the laser incident extending path; and a plurality of second auxiliary gas cell modules coupled to a second side surface of the main gas cell module, each individual second auxillary gas cell module comprising:

a second auxiliary housing configured to form the entirety of a body of the second auxiliary gas cell module thereof that is coupled to the second side surface of the main gas cell module by a fixative, an EUV emission extending path formed on a first side surface of the second auxiliary housing to communicate with the EUV emission path on a coaxial line so as to emit the EUV beam received from the EUV emission path into the vacuum chamber, and a second gas discharge flow path formed on a second side surface of the second auxiliary housing to communicate with the EUV emission extending path so as to discharge the inert gas supplied to the EUV emission path to the outside of the vacuum chamber through the EUV emission extending path, wherein the inert gas is supplied from the outside of the vacuum chamber to the gas supply flow path through a gas supply port and a gas supply pipe which are connected to an end of the gas supply flow path, and the inert gas is discharged to the outside of the vacuum chamber through first and second gas discharge ports and first and second gas discharge pipes which are respectively connected to ends of the first and second gas discharge flow paths.

2. The apparatus of claim 1, wherein at least two of the first and second auxiliary gas cell modules extend and are respectively coupled to the first and second side surfaces of the main gas cell module.

3. The apparatus of claim 1, further comprising a pressure controller provided at any one portion of the gas supply port, the gas supply pipe, and a portion therebetween and configured to control a pressure and a flow rate of the inert gas according to an intensity of the laser beam.

4. The apparatus of claim 1, further comprising a pressure adjusting valve provided at any one portion of the first and second gas discharge ports, the first and second gas discharge pipes, a portion between the first and second gas discharge ports, and a portion between the first and second gas discharge pipes and configured to adjust a pressure of the inert gas using an aperture principle.

5. The apparatus of claim 1, wherein diameters of the laser incident path and the EUV emission path of the main gas cell module, and diameters of the laser incident extending path and the EUV emission extending path of the first and second auxiliary gas cell modules are formed to be smaller than a diameter of the gas supply flow path of the main gas cell module and diameters of the first and second gas discharge flow paths of the first and second auxiliary gas cell modules.

6. The apparatus of claim 1, wherein the inert gas includes at least any one of helium (He), neon (Ne), and argon (Ar).

7. The apparatus of claim 1, further comprising an auxiliary housing configured to be included in the first and second auxiliary gas cell modules and having a diameter of a hole smaller than or equal to diameters of the laser incident path, the laser incident extending path, and the EUV emission extending path as required.

* * * * *